US012247509B2

(12) United States Patent
Matsumoto

(10) Patent No.: US 12,247,509 B2
(45) Date of Patent: Mar. 11, 2025

(54) CATALYST TEMPERATURE CONTROL APPARATUS AND CATALYST TEMPERATURE CONTROL METHOD

(71) Applicant: ISUZU MOTORS LIMITED, Yokohama (JP)

(72) Inventor: Atsushi Matsumoto, Fujisawa (JP)

(73) Assignee: ISUZU MOTORS LIMITED, Yokohama (JP)

( * ) Notice: Subject to any disclaimer, the term of this patent is extended or adjusted under 35 U.S.C. 154(b) by 0 days.

(21) Appl. No.: 18/604,277

(22) Filed: Mar. 13, 2024

(65) Prior Publication Data

US 2024/0328338 A1 Oct. 3, 2024

(30) Foreign Application Priority Data

Mar. 27, 2023 (JP) ..... 2023-049743

(51) Int. Cl.
*F01N 3/20* (2006.01)
*F01N 3/10* (2006.01)
(Continued)

(52) U.S. Cl.
CPC ..... *F01N 3/208* (2013.01); *F01N 3/101* (2013.01); *F01N 3/2013* (2013.01); *F01N 9/005* (2013.01); *F01N 11/002* (2013.01); *F01N 2560/06* (2013.01); *F01N 2560/07* (2013.01); *F01N 2560/14* (2013.01); *F01N 2900/0422* (2013.01);
(Continued)

(58) Field of Classification Search
CPC ..... F01N 2240/16; F01N 2900/08; F01N 2900/10; F01N 2590/11; F01N 2900/0601; F01N 3/2013; F01N 2900/1602; F01N 2550/02; F01N 3/2006; F01N 11/007; F01N 9/00; F01N 11/002
See application file for complete search history.

(56) References Cited

U.S. PATENT DOCUMENTS

2007/0056264 A1* 3/2007 Hou ..... F01N 9/005 60/274
2013/0035845 A1 2/2013 Takara
2022/0099043 A1 3/2022 Suzuki

FOREIGN PATENT DOCUMENTS

JP 2011-231667 A 11/2011
JP 2020-197180 A 12/2020
(Continued)

*Primary Examiner* — Anthony Ayala Delgado
(74) *Attorney, Agent, or Firm* — PROCOPIO, CORY, HARGREAVES & SAVITCH LLP

(57) ABSTRACT

A catalyst temperature control apparatus includes: a calculation part calculating an amount of heat transfer obtained by adding together i) an amount of heat that transfers from a wall surface of a catalyst to exhaust based on an exhaust temperature, exhaust flow rate, and catalyst wall surface temperature of an upstream side of the catalyst, and ii) an amount of heat that transfers from the wall surface of the catalyst to the outside air around the catalyst based on the catalyst wall surface temperature, the outside air temperature, and a vehicle speed; and a heater control part causing a heater provided upstream of the catalyst to generate heat if an estimated catalyst wall surface temperature of the catalyst after a first predetermined time period, which has been estimated on the basis of the amount of heat transfer and the catalyst wall surface temperature, is lower than a threshold.

11 Claims, 6 Drawing Sheets

(51) Int. Cl.
*F01N 9/00* (2006.01)
*F01N 11/00* (2006.01)

(52) U.S. Cl.
CPC .. *F01N 2900/0601* (2013.01); *F01N 2900/10* (2013.01); *F01N 2900/1602* (2013.01)

(56) References Cited

FOREIGN PATENT DOCUMENTS

| | | | |
|---|---|---|---|
| JP | 2021-134730 | A | 9/2021 |
| WO | 2020/189080 | A1 | 9/2020 |

* cited by examiner

CATALYST TEMPERATURE CONTROL APPARATUS AND CATALYST TEMPERATURE CONTROL METHOD

CROSS-REFERENCE TO RELATED APPLICATIONS

The present application claims priority to Japanese Patent Application number 2023-049743, filed on Mar. 27, 2023, contents of which are incorporated herein by reference in its entirety.

BACKGROUND OF THE INVENTION

The present disclosure relates to a catalyst temperature control apparatus and a catalyst temperature control method.

A conventional vehicle control apparatus heats a catalyst before engine startup if the catalyst temperature is lower than a predetermined temperature (for example, Japanese Unexamined Patent Application Publication No. 2011-231667).

Immediately after the engine is started, the low-temperature exhaust discharged from the engine exchanges heat with the catalyst, lowering the catalyst temperature. Consequently, the catalyst temperature, previously increased before engine startup, may become lower than the temperature required for catalyst activation.

BRIEF SUMMARY OF THE INVENTION

The present disclosure has been made in view of these points, and its object is to maintain the catalyst temperature after engine startup within a predetermined range.

A catalyst temperature control apparatus according to a first aspect of the present disclosure includes: an acquiring part that acquires an exhaust temperature of an upstream side of a catalyst in an exhaust passage, an exhaust flow rate in the exhaust passage, a catalyst wall surface temperature of a wall surface of the catalyst, an outside air temperature around the catalyst, and a vehicle speed of a vehicle including the catalyst; a calculation part that calculates an amount of heat transfer obtained by adding together i) an amount of heat that transfers from the wall surface of the catalyst to exhaust in the exhaust passage based on the exhaust temperature, the exhaust flow rate, and the catalyst wall surface temperature, and ii) an amount of heat that transfers from the wall surface of the catalyst to outside air around the catalyst based on the catalyst wall surface temperature, the outside air temperature, and the vehicle speed; and a heater control part that causes a heater provided upstream of the catalyst to generate heat if an estimated catalyst wall surface temperature of the catalyst after a first predetermined time period from a current timing, which has been estimated on the basis of the amount of heat transfer and the catalyst wall surface temperature, is lower than a threshold.

A catalyst temperature control method according to a second aspect of the present disclosure, executed by a computer, includes the steps of: acquiring an exhaust temperature of an upstream side of a catalyst in an exhaust passage, an exhaust flow rate in the exhaust passage, a catalyst wall surface temperature of a wall surface of the catalyst, an outside air temperature around the catalyst, and a vehicle speed of a vehicle including the catalyst; calculating an amount of heat transfer obtained by adding together i) an amount of heat that transfers from the wall surface of the catalyst to exhaust in the exhaust passage based on the exhaust temperature, the exhaust flow rate, and the catalyst wall surface temperature, and ii) an amount of heat that transfers from the wall surface of the catalyst to outside air around the catalyst based on the catalyst wall surface temperature, the outside air temperature, and the vehicle speed; and causing a heater provided upstream of the catalyst in which an estimated catalyst wall surface temperature after a first predetermined time period from the current timing, which has been estimated on the basis of the amount of heat transfer and the catalyst wall surface temperature, is lower than a threshold to generate heat.

DETAILED DESCRIPTION OF THE INVENTION

Hereinafter, the present disclosure will be described through exemplary embodiments, but the following exemplary embodiments do not limit the invention according to the claims, and not all of the combinations of features described in the exemplary embodiments are necessarily essential to the solution means of the invention.

<Outline of the Catalyst Temperature Control System S>

Figure 1:
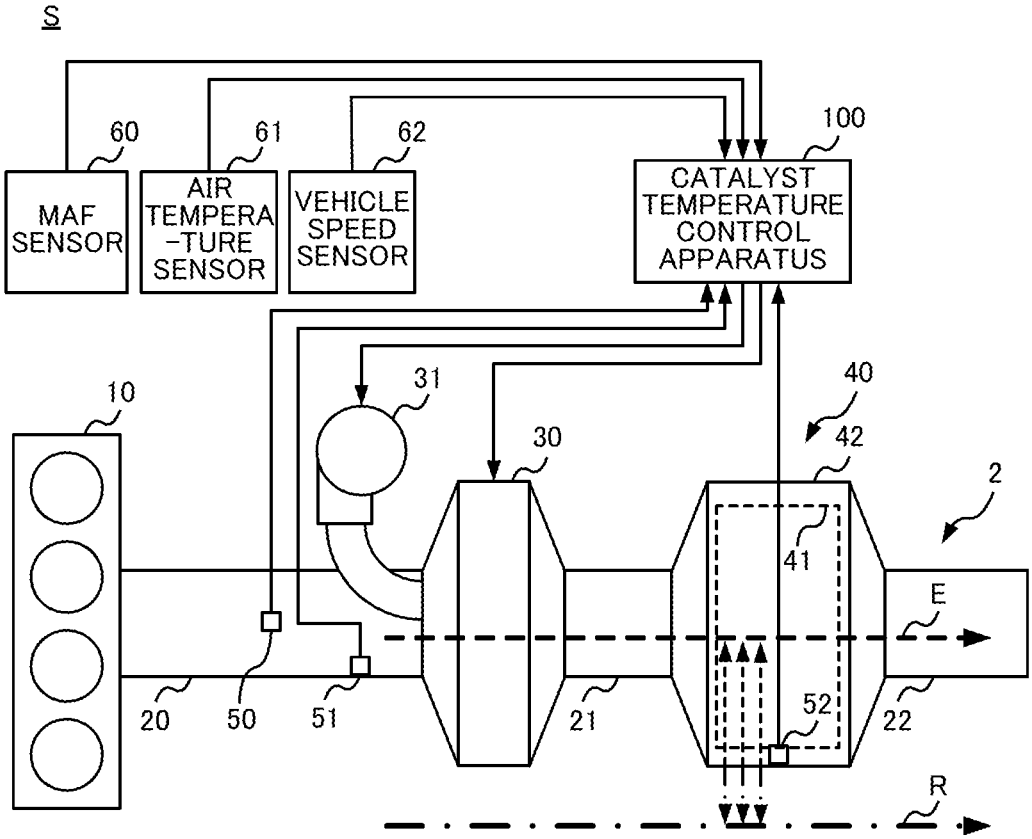
FIG. 1 is a diagram showing a configuration of a catalyst temperature control system S according to the present embodiment.

FIG. 1 is a diagram showing a configuration of a catalyst temperature control system S according to the present embodiment. The catalyst temperature control system S shown in FIG. 1 includes an engine 10, an exhaust passage 2, a heater 30, a blower 31, a purification device 40, a temperature sensor 50, a temperature sensor 51, a temperature sensor 52, a Mass Air Flow (MAF) sensor 60, an air temperature sensor 61, a vehicle speed sensor 62, and a catalyst temperature control apparatus 100. The exhaust passage 2 includes an exhaust passage 20, an exhaust passage 21, and an exhaust passage 22. In FIG. 1, exhaust E indicates the flow of exhaust of the engine 10, and traveling wind R indicates wind generated by traveling of a vehicle equipped with the catalyst temperature control system S.

The catalyst temperature control system S has a function of raising the temperature of a catalyst 41 included in the purification device 40 to a temperature at which the catalyst 41 is activated (hereinafter referred to as an "activation temperature") by causing the heater 30 to generate heat. The activation temperature is 200° C., for example.

The engine 10 is an internal combustion engine that burns and expands a mixture of fuel and intake air (air) to generate power. The exhaust passage 20, the exhaust passage 21, and the exhaust passage 22 are passages through which exhaust of the engine 10 flows. The exhaust passage 20 is provided downstream of the engine 10 and upstream of the heater 30, the exhaust passage 21 is provided downstream of the heater 30 and upstream of the purification device 40, and the exhaust passage 22 is provided downstream of the purification device 40. The heater 30 is an electric heater, for example, and generates heat by being energized. The heater 30 is provided upstream of the purification device 40. The blower 31 is a blower for blowing air into the heater 30.

The purification device 40 is a device for purifying exhaust of the engine 10, and includes the catalyst 41 and a case 42 that houses the catalyst 41. The catalyst 41 is a three-way catalyst, for example, and purifies hydrocarbon (HC), carbon monoxide (CO), and nitrogen oxide (NOx) contained in exhaust of the engine 10. Specifically, the catalyst 41 oxidizes hydrocarbon into water and carbon dioxide, oxidizes carbon monoxide into carbon dioxide, and reduces nitrogen oxide to nitrogen. The catalyst 41 may be a Selective Catalytic Reduction (SCR) catalyst.

The temperature sensor 50, the temperature sensor 51, and the temperature sensor 52 are thermocouples or thermistors, for example. The temperature sensor 50 is provided in the exhaust passage 20 and detects an exhaust temperature in the exhaust passage 20. The temperature sensor 50 may be provided downstream of the position shown in FIG. 1 in the exhaust passage 20 (i.e., in the vicinity of the inlet of the heater 30) or upstream of the catalyst 41 in the exhaust passage 21 (e.g., in the vicinity of the inlet of the catalyst 41). The temperature sensor 51 is provided in the exhaust passage 20 and detects a wall surface temperature of the exhaust passage 20. The temperature sensor 52 is provided on an inner periphery of the case 42 or an outer periphery of the catalyst 41, and detects a wall surface temperature of the catalyst 41. The temperature sensor 52 may detect a wall surface temperature of the case 42 as the wall surface temperature of the catalyst 41. It should be noted that the heater 30 is not provided with a temperature sensor.

The MAF sensor 60 is a flow rate sensor that detects an intake amount of the engine 10. The air temperature sensor 61 is a temperature sensor that detects the temperature around the catalyst temperature control system S (i.e., an outside air temperature). The vehicle speed sensor 62 is a speed sensor that detects a vehicle speed of a vehicle equipped with the catalyst temperature control system S.

The catalyst temperature control apparatus 100 executes processing of raising the temperature of the catalyst 41 by causing the heater 30 to generate heat. The catalyst temperature control apparatus 100 may have a housing including electronic components, or may be a printed circuit board on which electronic components are mounted.

In the catalyst temperature control system S, the heater 30 generates heat, and the blower 31 blows air into the heater 30 before the engine 10 is started. The heater 30 and the blower 31 operating in this manner cause air in the heater 30 that has exchanged heat with the heater 30 to flow into the catalyst 41, so that the temperature of the catalyst 41 rises due to heat exchange between the air and the catalyst 41. Starting the engine 10 after the temperature of the catalyst 41 has reached the activation temperature enables the catalyst 41 to purify exhaust of the engine 10 immediately after the engine 10 is started.

However, immediately after the engine 10 is started, since the exhaust temperature is lower than the temperature of the catalyst 41 and the heater 30 is not generating heat, heat exchange between the catalyst 41 and the exhaust reduces the temperature of the catalyst 41. Further, since the traveling wind R blows on the purification device 40, heat exchange between the catalyst 41 and the traveling wind R through the case 42 further reduces the temperature of the catalyst 41. As a result, the temperature of the catalyst 41 decreases to a temperature that is lower than the activation temperature. Accordingly, the catalyst temperature control apparatus 100 estimates a wall surface temperature of the catalyst 41 after a first predetermined time period (e.g., 20 seconds) from the current timing by calculating the amount of heat that transfers from the catalyst 41 to the exhaust E and the traveling wind R, and raises the temperature of the catalyst 41 by causing the heater 30 to generate heat if the estimated wall surface temperature is lower than the activation temperature.

For example, the catalyst temperature control apparatus 100 calculates a first amount of heat that transfers from the catalyst 41 to the exhaust E on the basis of the exhaust temperature detected by the temperature sensor 50, an exhaust flow rate based on the intake amount detected by the MAF sensor 60, and the wall surface temperature of the catalyst 41. The catalyst temperature control apparatus 100 calculates a second amount of heat that transfers from the catalyst 41 to the traveling wind R through the case 42 on the basis of the wall surface temperature of the catalyst 41 detected by the temperature sensor 52, the outside air temperature detected by the air temperature sensor 61, and the vehicle speed detected by the vehicle speed sensor 62. Then, the catalyst temperature control apparatus 100 causes the heater 30 to generate heat if the wall surface temperature of the catalyst 41 after the first predetermined time period from the current timing, which has been estimated on the basis of the calculated first amount of heat and second amount of heat, is lower than the activation temperature. The catalyst temperature control apparatus 100 operating in this manner can maintain the temperature of the catalyst 41 after the engine 10 is started at a temperature that is equal to or higher than the activation temperature.

Hereinafter, a configuration and operation of the catalyst temperature control apparatus 100 will be described in detail.

<Configuration of the Catalyst Temperature Control Apparatus 100>

Figure 2:
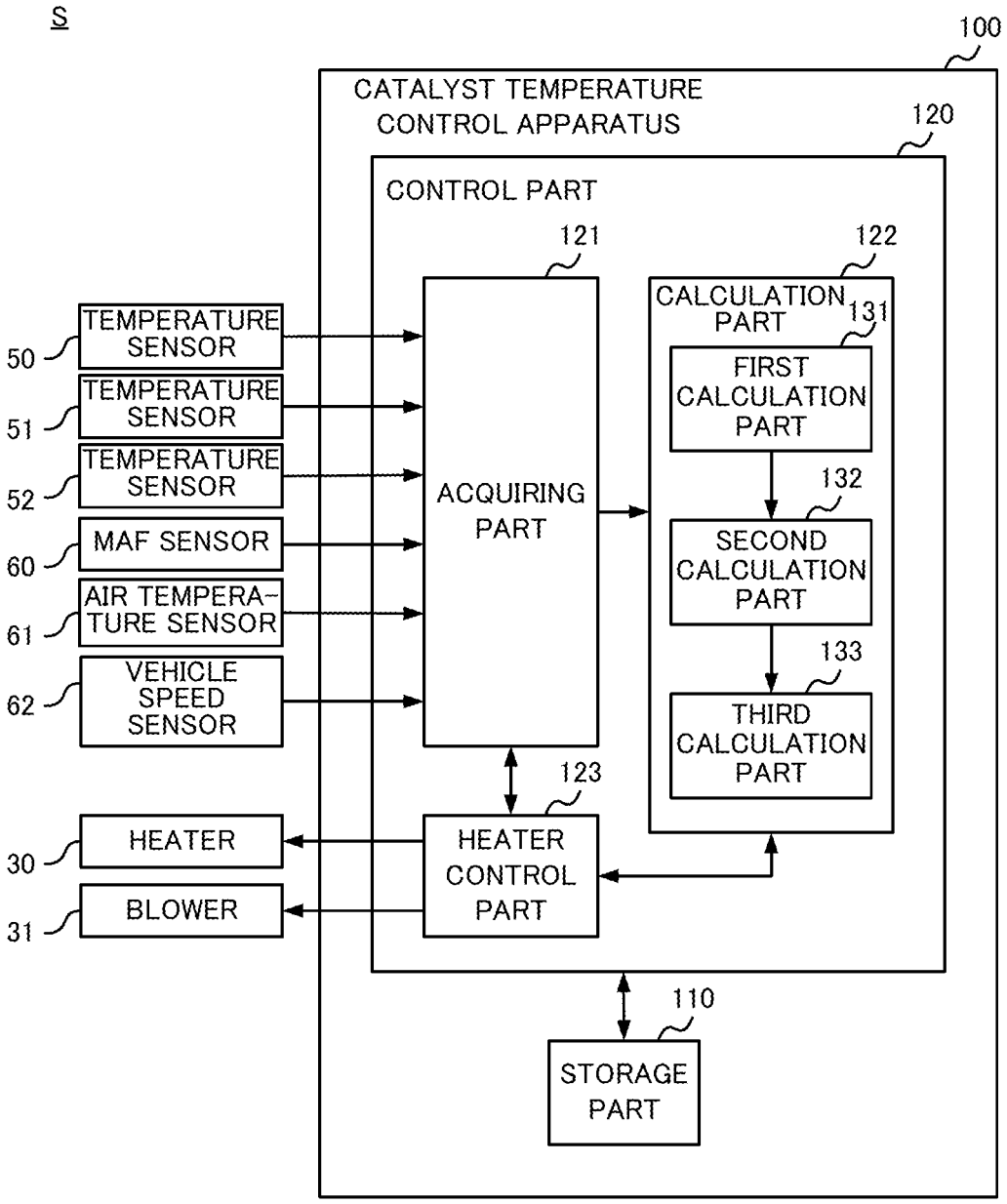
FIG. 2 is a diagram showing a configuration of a catalyst temperature control apparatus 100.

FIG. 2 is a diagram showing a configuration of the catalyst temperature control apparatus 100. The catalyst temperature control apparatus 100 includes a storage part 110 and a control part 120. The control part 120 includes an acquiring part 121, a calculation part 122, and a heater control part 123. The calculation part 122 includes a first calculation part 131, a second calculation part 132, and a third calculation part 133.

The storage part 110 includes a storage medium such as a Read Only Memory (ROM), a Random Access Memory (RAM), a Hard Disk Drive (HDD), or a Solid State Drive (SSD). The storage part 110 stores a program executed by the control part 120. The storage part 110 stores various types of information for estimating the wall surface temperature of the catalyst 41 after the first predetermined time period from the current timing.

The control part 120 is a processor such as a Central Processing Unit (CPU) or an Electronic Control Unit (ECU), for example. The control part 120 functions as the acquiring part 121, the calculation part 122, and the heater control part 123 by executing a program stored in the storage part 110. It should be noted that the control part 120 may be configured by a single processor, or may be configured by a plurality of processors or a combination of one or more processors and an electronic circuit.

A configuration of each part implemented by the control part 120 will be described below.

The acquiring part 121 acquires an exhaust temperature of an upstream side of the catalyst 41, an exhaust flow rate of the exhaust passage 20, a catalyst wall surface temperature of a wall surface of the catalyst 41, an outside air temperature around the catalyst 41, and a vehicle speed of the vehicle including the catalyst 41. The exhaust temperature of the upstream side of the catalyst 41 is at least one of a first exhaust temperature of the exhaust passage 20, a second exhaust temperature of the inlet of the heater 30, or a third exhaust temperature of the inlet of the catalyst 41, for example. In the present embodiment, an operation of the acquiring part 121 to acquire the first exhaust temperature will be described as an example. The acquiring part 121 acquires the first exhaust temperature detected by the temperature sensor 50, the exhaust flow rate corresponding to the intake amount of the engine 10 detected by the MAF sensor 60, the catalyst wall surface temperature detected by the temperature sensor 52, the outside air temperature detected by the air temperature sensor 61, and the vehicle speed detected by the vehicle speed sensor 62, for example. The acquiring part 121 may acquire the intake amount detected by the MAF sensor 60 as an exhaust flow rate of the engine 10.

The acquiring part 121 may further acquire a passage wall surface temperature of a wall surface of an upstream side of the heater 30 and a heater wall surface temperature of a wall surface of the heater 30. The acquiring part 121 acquires the passage wall surface temperature detected by the temperature sensor 51, for example. The acquiring part 121 acquires the passage wall surface temperature as the initial value of the heater wall surface temperature, and acquires, as the heater wall surface temperature, an estimated heater wall surface temperature estimated by the heater control part 123, each time a second predetermined time period passes, for example. The second predetermined time period is a time period that is smaller than the first predetermined time period, and is one second, for example. Details of the estimated heater wall surface temperature will be described later.

The calculation part 122 calculates the first amount of heat that transfers from the wall surface of the catalyst 41 to the exhaust E based on the exhaust temperature, exhaust flow rate, and catalyst wall surface temperature acquired by the acquiring part 121. The calculation part 122 calculates the second amount of heat that transfers from the wall surface of the catalyst 41 to the outside air around the catalyst 41 (that is, the traveling wind R) through the case 42, based on the catalyst wall surface temperature, outside air temperature, and vehicle speed acquired by the acquiring part 121. Then, the calculation part 122 calculates the amount of heat transfer, which is obtained by adding together the first amount of heat and the second amount of heat. The calculation part 122 calculates the amount of heat transfer each time the second predetermined time period passes, for example.

The operation of the calculation part 122 to calculate the first amount of heat and the second amount of heat will now be described. The amount of heat Q [w] that transfers from the wall surface of the catalyst 41 to the exhaust E or the traveling wind R can be calculated by Equation 1 using a heat transfer rate $h_c$, a heat transfer area A, a wall surface temperature $T_w$, and a fluid temperature $T_g$. The fluid temperature $T_g$ is an exhaust temperature when the first amount of heat is calculated, and is an outside air temperature when the second amount of heat is calculated. The heat transfer area A is stored in the storage part 110.

$$Q[w] = h_c A(T_w - T_g) \tag{1}$$

The heat transfer rate $h_c$ can be calculated by Equation 2 using a Nusselt number $N_u$, a wall surface heat transfer rate k, and a representative length L. The representative length L is a pipe diameter of an exhaust pipe forming the exhaust passage 20, the exhaust passage 21, and the exhaust passage 22 when the first amount of heat is calculated, and is the total length of the exhaust pipe including the exhaust passage 20, the exhaust passage 21, and the exhaust passage 22 when the second amount of heat is calculated. The pipe diameter and the total length of the exhaust pipe and the wall surface heat transfer rate k are stored in the storage part 110.

$$h_c = N_u \frac{k}{L} \tag{2}$$

The Nusselt number $N_u$ can be expressed by Equation 3 when the first amount of heat is calculated, and can be expressed by Equation 4 when the second amount of heat is calculated. $R_e$ is a Reynolds number, and $P_r$ is a Prandtl number. The Reynolds number $R_e$ is calculated using a wall surface temperature, a fluid temperature, a fluid velocity, a flow path shape, and physical property values obtained by numerically expressing the properties of a wall surface and a fluid substance. The Prandtl number $P_r$ is calculated using the wall surface temperature, the fluid temperature, and the physical property value of the fluid. The flow path shape (shape of a downstream side of the engine 10) and the physical property values of the wall surface and the fluid (exhaust and outside air) are stored in the storage part 110.

$$N_u = 0.023 R_e^{0.8} P_r^{0.4} \tag{3}$$

$$N_u = 0.332 R_e^{0.5} P_r^{0.33} \tag{4}$$

When calculating the first amount of heat, the calculation part 122 calculates the Reynolds number $R_e$ and the Prandtl number $P_r$ using the catalyst wall surface temperature, the exhaust temperature, an exhaust flow speed obtained by dividing the exhaust flow rate by a cross-sectional area of the flow path stored in the storage part 110, and the flow path shape and physical property values stored in the storage part 110. Then, the calculation part 122 calculates the Nusselt number $N_u$ by substituting the Reynolds number $R_e$ and the Prandtl number $P_r$ into Equation 3, and calculates the heat transfer rate $h_c$ by substituting the Nusselt number $N_u$ into Equation 2. The calculation part 122 calculates the first amount of heat by substituting the exhaust temperature used as the fluid temperature $T_g$, the catalyst wall surface temperature used as the wall surface temperature $T_w$, and the calculated heat transfer rate $h_c$ into Equation 1.

When calculating the second amount of heat, the calculation part 122 calculates the Reynolds number $R_e$ and the Prandtl number $P_r$ using the catalyst wall surface temperature, the outside air temperature, the vehicle speed substituted as the fluid speed, and the flow path shape and the physical property values stored in the storage part 110. Then, the calculation part 122 calculates the Nusselt number $N_u$ by substituting the Reynolds number $R_e$ and the Prandtl number $P_r$ into Equation 4, and calculates the heat transfer rate $h_c$ by substituting the Nusselt number $N_u$ into Equation 2. The calculation part 122 calculates the second amount of heat by substituting the outside air temperature used as the fluid temperature $T_g$, the catalyst wall surface temperature used as the wall surface temperature $T_w$, and the calculated heat transfer rate $h_c$ into Equation 1.

The operation of the calculation part 122 to calculate the first amount of heat and the second amount of heat has been described above.

In the above description, the operation of the calculation part 122 to calculate the amount of heat transfer using one of the first exhaust temperature of the exhaust passage 20, second exhaust temperature of the inlet of the heater 30, or third exhaust temperature of the inlet of the catalyst 41 detected by the temperature sensor 50 is described, but the present embodiment is not limited to this. The calculation part 122 may calculate the amount of heat transfer of the exhaust passage 20, the heater 30, and the catalyst 41 respectively by calculating the second exhaust temperature and the third exhaust temperature using the first exhaust temperature. In this case, the calculation part 122 includes a first calculation part 131 that calculates a first amount of heat transfer of the exhaust passage 20, a second calculation part 132 that calculates a second amount of heat transfer of the heater 30, and a third calculation part 133 that calculates a third amount of heat transfer of the catalyst 41.

The first calculation part 131 calculates the second exhaust temperature of the inlet of the heater 30 on the basis of i) the first amount of heat transfer that occurs from the wall surface of the upstream side of the heater 30 to the exhaust E and the outside air (traveling wind R), based on the first exhaust temperature, the exhaust flow rate of the exhaust passage 20, the passage wall surface temperature, the outside air temperature, and the vehicle speed, and ii) the first exhaust temperature.

Figure 3:
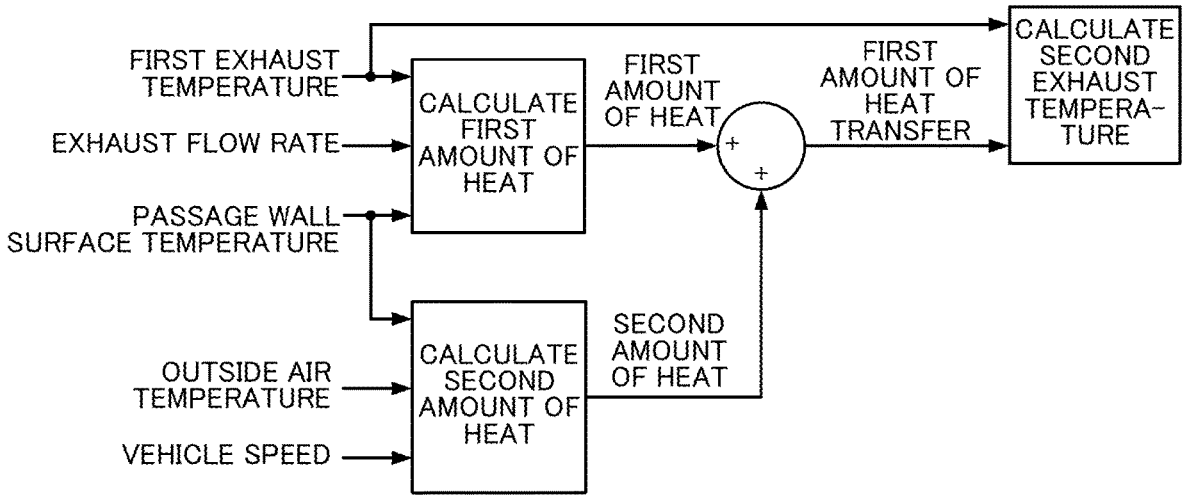
FIG. 3 is a diagram for explaining the operation of a first calculation part 131.

FIG. 3 is a diagram for explaining the operation of the first calculation part 131. As shown in FIG. 3, the first calculation part 131 calculates the first amount of heat that transfers from the wall surface of the upstream side of the heater 30 to the exhaust E based on the first exhaust temperature, the exhaust flow rate, and the passage wall surface temperature. The first calculation part 131 calculates the second amount of heat that transfers from the wall surface of the upstream side of the heater 30 to the outside air (traveling wind R) around the heater 30 based on the passage wall surface temperature, the outside air temperature, and the vehicle speed. The first calculation part 131 calculates the first amount of heat transfer, which is obtained by adding together the calculated first amount of heat and second amount of heat, and calculates the second exhaust temperature on the basis of the first amount of heat transfer and the first exhaust temperature.

The second calculation part 132 calculates the third exhaust temperature of the inlet of the catalyst 41 on the basis of i) the second amount of heat transfer that occurs from the wall surface of the heater 30 to the exhaust E and the outside air (traveling wind R) based on the second exhaust temperature calculated by the first calculation part 131, the exhaust flow rate of the exhaust passage 20, the heater wall surface temperature, the outside air temperature, and the vehicle speed, and ii) the second exhaust temperature.

Figure 4:
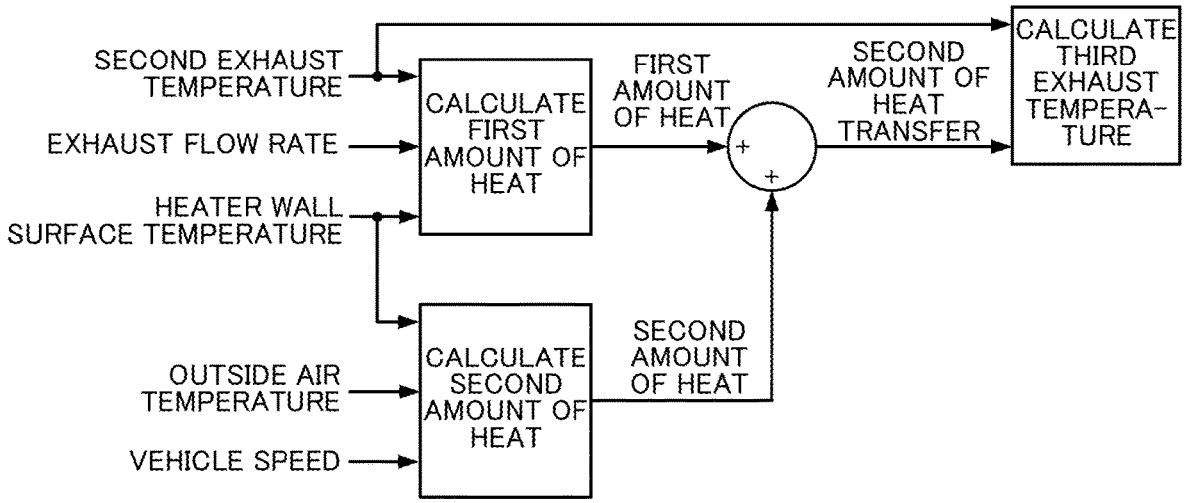
FIG. 4 is a diagram for explaining the operation of a second calculation part 132.

FIG. 4 is a diagram for explaining the operation of the second calculation part 132. As shown in FIG. 4, the second calculation part 132 calculates the first amount of heat that transfers from the wall surface of the heater 30 to the exhaust E based on the second exhaust temperature, the exhaust flow rate, and the heater wall surface temperature. The second calculation part 132 calculates the second amount of heat that transfers from the wall surface of the heater 30 to the outside air (traveling wind R) around the heater 30 based on the heater wall surface temperature, the outside air temperature, and the vehicle speed. The second calculation part 132 calculates the second amount of heat transfer, which is obtained by adding together the calculated first amount of heat and second amount of heat, and calculates the third exhaust temperature on the basis of the second amount of heat transfer and the second exhaust temperature.

Figure 5:
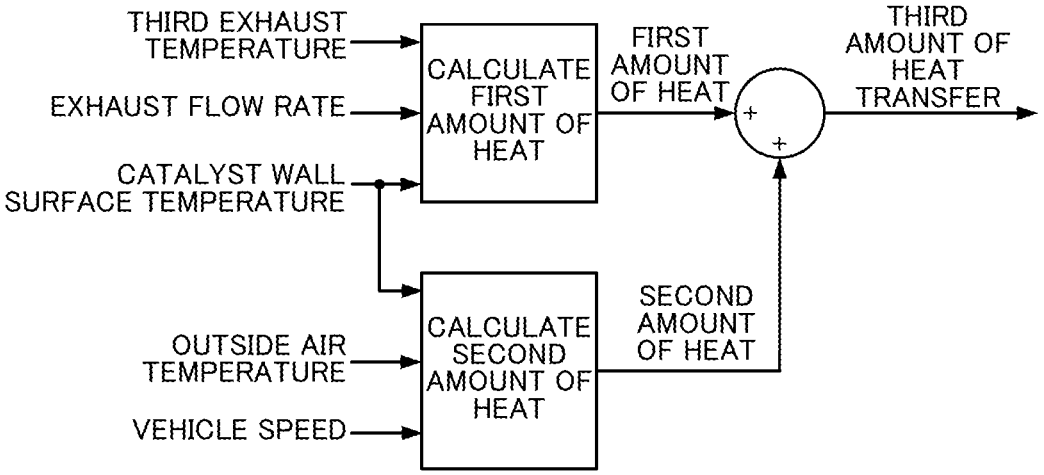
FIG. 5 is a diagram for explaining the operation of a third calculation part 133.

The third calculation part 133 calculates the third amount of heat transfer that occurs from the wall surface of the catalyst to the exhaust E and the outside air (traveling wind R) based on the third exhaust temperature calculated by the second calculation part 132, the exhaust flow rate, the catalyst wall surface temperature, the outside air temperature, and the vehicle speed. FIG. 5 is a diagram for explaining the operation of the third calculation part 133. As shown in FIG. 5, the third calculation part 133 calculates the first amount of heat that transfers from the wall surface of the catalyst to the exhaust E based on the third exhaust temperature, the exhaust flow rate, and the catalyst wall surface temperature. The third calculation part 133 calculates the second amount of heat that transfers from the wall surface of the catalyst 41 to the outside air (traveling wind R) around the catalyst 41 through the case 42 based on the catalyst wall surface temperature, the outside air temperature, and the vehicle speed. The third calculation part 133 calculates the third amount of heat transfer, which is obtained by adding together the calculated first amount of heat and second amount of heat.

The calculation part 122 operating in this manner makes it possible to calculate the exhaust temperature at a position that is closer to the catalyst 41 than the position of the temperature sensor 50 (that is, the inlet of the catalyst 41) on the basis of the exhaust temperature detected by the temperature sensor 50 provided in the exhaust passage 20. As a result, the calculation part 122 can calculate the amount of heat transfer of the catalyst 41 with high accuracy, thereby increasing the accuracy of estimating the wall surface temperature of the catalyst 41 after the first predetermined time period from the current timing performed by the heater control part 123.

If the estimated catalyst wall surface temperature of the catalyst 41 after the first predetermined time period from the current timing, which has been estimated on the basis of the amount of heat transfer calculated by the calculation part 122 and the catalyst wall surface temperature, is lower than a threshold, the heater control part 123 causes the heater 30 provided upstream of the catalyst 41 to generate heat. The threshold is a lower limit value of the activation temperature, and is 200° C., for example. The first predetermined time period is 20 seconds, for example. It should be noted that the heater control part 123 estimates the estimated catalyst wall surface temperature after the first predetermined time period from the current timing, on the basis of the catalyst wall surface temperature and the third amount of heat transfer when the calculation part 122 includes the third calculation part 133.

The heater control part 123 estimates the estimated catalyst wall surface temperature on the basis of i) a divided value obtained by dividing the product of the amount of heat transfer calculated by the calculation part 122 and the cycle at which the calculation part 122 calculates the amount of heat transfer, by the heat capacity of the catalyst 41 stored in the storage part 110, and ii) the catalyst wall surface temperature, for example. The heater control part 123 may estimate the estimated catalyst wall surface temperature using a prediction model for predicting the catalyst wall surface temperature after the first predetermined time period from the current timing, by determining the amount of heat transfer and catalyst wall surface temperature stored in the storage part 110. Then, the heater control part 123 causes the heater 30 to generate heat if the estimated catalyst wall surface temperature is lower than the threshold, and does not cause the heater 30 to generate heat if the estimated catalyst wall surface temperature is equal to or higher than the threshold.

The heater control part 123 operating in this manner can cause the heater 30 to generate heat when there is a concern that the wall surface temperature of the catalyst 41 might become lower than the activation temperature. As a result, in the catalyst temperature control system S, heat exchange between the heater 30 and exhaust in the heater 30 can raise the temperature of exhaust flowing through the catalyst 41, making it possible to prevent a decrease in the temperature of the catalyst 41 and to maintain the activation temperature.

The heater control part 123 estimates the estimated catalyst wall surface temperature each time the second predetermined time period that is smaller than the first predetermined time period passes, for example. The second predetermined time period is one second, for example. Each time the second predetermined time period passes, the heater control part 123 causes the heater 30 to generate heat if the estimated catalyst wall surface temperature is lower than the threshold, and does not cause the heater 30 to generate heat if the estimated catalyst wall surface temperature is equal to or higher than the threshold. Even though the temperature of the catalyst 41 and the flow rate of the exhaust flowing into the catalyst 41 change over time, the heater control part 123 operating in this manner can estimate the estimated catalyst wall surface temperature in accordance with a change and control whether or not to cause the heater 30 to generate heat. As a result, the heater control part 123 can improve the accuracy of maintaining the temperature of the catalyst 41 at the activation temperature.

In a case where the calculation part 122 includes the second calculation part 132, the heater control part 123 estimates the estimated heater wall surface temperature of the heater 30 after the second predetermined time period from the current timing, on the basis of i) a difference between the second amount of heat transfer and the amount of heat of the heater 30 and ii) the heater wall surface temperature, each time the second predetermined time period passes.

The heater control part 123 estimates the estimated heater wall surface temperature after the second predetermined time period from the current timing, on the basis of i) a subtraction value obtained by subtracting the amount of heat generated by the heater 30 in the second predetermined time period from the second amount of heat transfer calculated by the second calculation part 132, and ii) the heater wall surface temperature at the current timing, each time the second predetermined time period passes, for example. The heater control part 123 may estimate the estimated heater wall surface temperature using a prediction model for predicting the estimated heater wall surface temperature after the second predetermined time period from the current timing, by determining the second amount of heat transfer, the amount of heat of the heater 30, and the heater wall surface temperature, for example. The prediction model is stored in the storage part 110, for example. The heater control part 123 provides notification about the estimated heater wall surface temperature to the acquiring part 121.

The heater control part 123 operating in this manner can estimate the estimated heater wall surface temperature that accounts for the amount of heat generated by the heater 30, even though the heater 30 is not provided with the temperature sensor (i.e., the wall surface temperature of the heater 30 cannot be detected). As a result, the second calculation part 132 can calculate the second amount of heat transfer and the third exhaust temperature by using the estimated heater wall surface temperature as the heater wall surface temperature.

<Processing Sequence in the Catalyst Temperature Control Apparatus 100>

Figure 6:
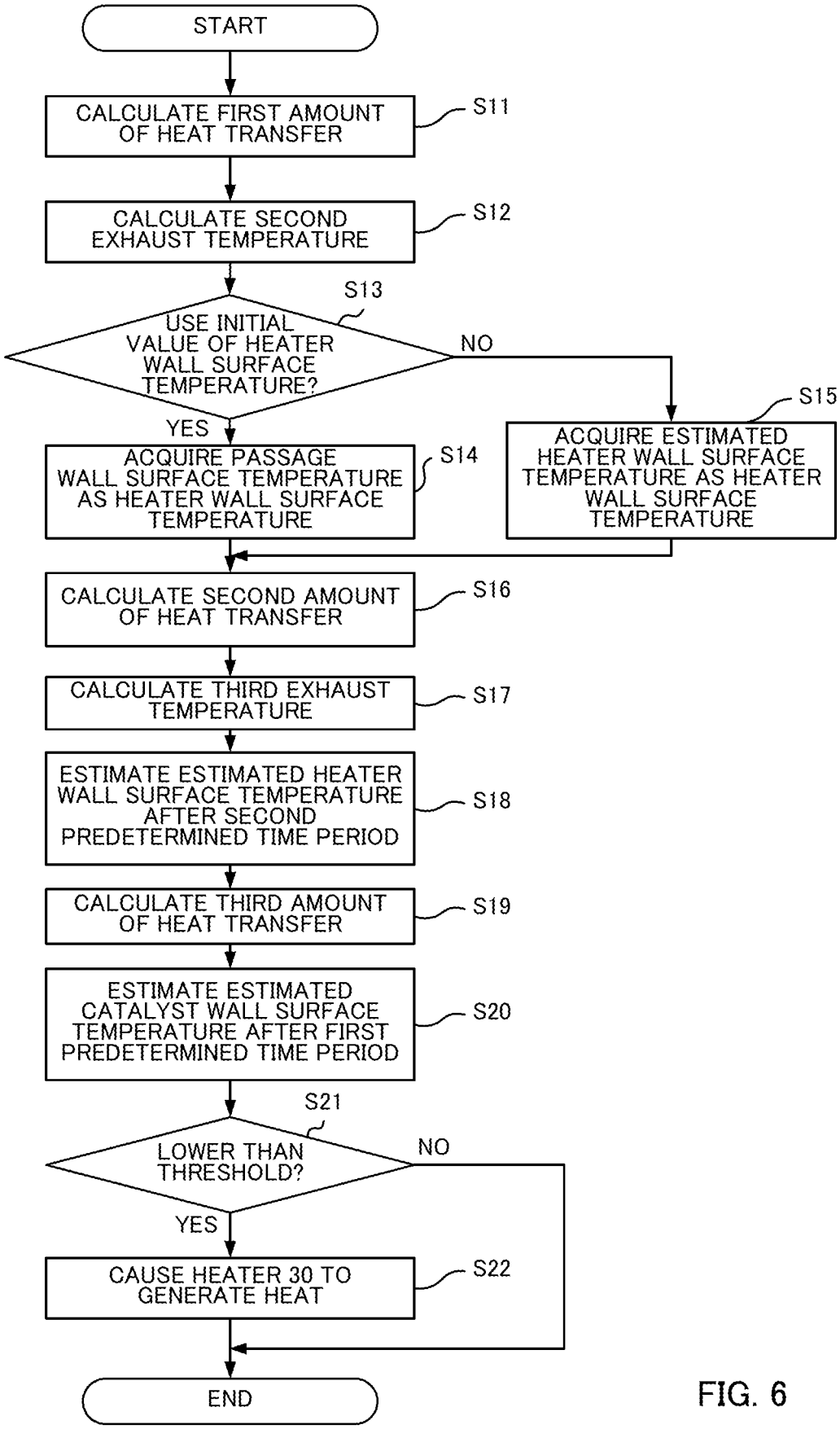
FIG. 6 is a diagram showing a processing sequence in the catalyst temperature control apparatus 100.

FIG. 6 is a diagram showing a processing sequence in the catalyst temperature control apparatus 100. The processing sequence shown in FIG. 6 shows operations of estimating the estimated catalyst wall surface temperature after the first predetermined time period from the current timing and determining whether or not to cause the heater 30 to generate heat. The catalyst temperature control apparatus 100 repeats the sequence shown in FIG. 6 each time the second predetermined time period passes.

The first calculation part 131 calculates the first amount of heat transfer that occurs from the wall surface of the upstream side of the heater 30 to the exhaust E and the traveling wind R, on the basis of the first exhaust temperature of the upstream side of the heater 30, the exhaust flow rate, the passage wall surface temperature, the outside air temperature, and the vehicle speed (S11). The first calculation part 131 calculates the second exhaust temperature indicating the exhaust temperature at the inlet of the heater 30 on the basis of the first amount of heat transfer and the first exhaust temperature (S12).

The second calculation part 132 acquires the heater wall surface temperature from the acquiring part 121. If the initial value of the heater wall surface temperature is used ("YES" in S13), the second calculation part 132 acquires the passage wall surface temperature as the heater wall surface temperature from the acquiring part 121 (S14). If the initial value of the heater wall surface temperature is not used ("NO" in S13), the second calculation part 132 acquires, from the acquiring part 121, the estimated heater wall surface temperature estimated by the heater control part 123 before the second predetermined time period from the current timing, as the heater wall surface temperature (S15). It should be noted that when the initial value of the heater wall surface temperature is used, the heater wall surface temperature is first acquired after the engine 10 has been started.

The second calculation part 132 calculates the second amount of heat transfer that occurs from the wall surface of the heater 30 to the exhaust E and the traveling wind R, on the basis of the second exhaust temperature, the exhaust flow rate, the heater wall surface temperature, the outside air temperature, and the vehicle speed (S16). The second calculation part 132 calculates the third exhaust temperature indicating the exhaust temperature at the inlet of the catalyst 41 on the basis of the second amount of heat transfer and the second exhaust temperature (S17).

The heater control part 123 estimates the estimated heater wall surface temperature after the second predetermined time period from the current timing, on the basis of i) a difference between the second amount of heat transfer and the amount of heat generated by the heater 30 and ii) the heater wall surface temperature acquired from the acquiring part 121 (S18). The heater control part 123 provides notification about the acquiring part 121 of the estimated heater wall surface temperature.

The third calculation part 133 calculates the third amount of heat transfer that occurs from the wall surface of the catalyst 41 to the exhaust E and the traveling wind R, on the basis of the third exhaust temperature, the exhaust flow rate, the catalyst wall surface temperature, the outside air temperature, and the vehicle speed (S19). The heater control part 123 estimates the estimated catalyst wall surface temperature after the first predetermined time period from the current timing, on the basis of the third amount of heat transfer and the catalyst wall surface temperature (S20). If the estimated catalyst wall surface temperature is lower than the threshold ("YES" in S21), the heater control part 123 causes the heater 30 to generate heat (S22). If the estimated catalyst wall surface temperature is equal to or higher than the threshold ("NO" in S21), the heater control part 123 ends the processing without causing the heater 30 to generate heat.

<Effect of the Catalyst Temperature Control Apparatus 100>

As described above, the catalyst temperature control apparatus 100 includes i) the acquiring part that acquires: the exhaust temperature of the upstream side of the catalyst 41 in the exhaust passage 2; the exhaust flow rate of the exhaust passage 2; the catalyst wall surface temperature of the wall surface of the catalyst 41; the outside air temperature around the catalyst 41; and the vehicle speed of the vehicle including the catalyst 41, ii) the calculation part 122 that calculates the amount of heat transfer obtained by adding together a) the amount of heat that transfers from the wall surface of the catalyst 41 to exhaust based on the exhaust temperature, the exhaust flow rate, and the catalyst wall surface temperature, and b) the amount of heat that transfers from the wall surface of the catalyst 41 to the outside air around the catalyst 41 through the case 42 based on the catalyst wall surface temperature, the outside air temperature, and the vehicle speed, and iii) the heater control part 123 that causes the heater 30 provided upstream of the catalyst 41 to generate heat if the estimated catalyst wall surface temperature of the catalyst 41 after the first predetermined time period from the current timing, which has been estimated on the basis of the amount of heat transfer and the catalyst wall surface temperature, is lower than the threshold.

The catalyst temperature control apparatus 100 configured in this manner can raise the temperature of the catalyst 41 by causing the heater 30 to generate heat, when it is estimated that the temperature of the catalyst 41 after the first predetermined time period from the current timing is lower than the lower limit value of the activation temperature. As a result, the catalyst temperature control apparatus 100 can maintain the temperature of the catalyst 41 within the range of the activation temperature immediately after the engine 10 has been started.

What is claimed is:

1. A catalyst temperature control apparatus comprising:

a processor coupled to a memory storing instructions to permit the processor to function as:

an acquiring part that acquires an exhaust temperature of an upstream side of a catalyst in an exhaust passage, an exhaust flow rate in the exhaust passage, a catalyst wall surface temperature of a wall surface of the catalyst, an outside air temperature around the catalyst, and a vehicle speed of a vehicle including the catalyst;

a calculation part that calculates an amount of heat transfer obtained by adding together i) an amount of heat that transfers from the wall surface of the catalyst to exhaust in the exhaust passage based on the exhaust temperature, the exhaust flow rate, and the catalyst wall surface temperature, and ii) an amount of heat that transfers from the wall surface of the catalyst to outside air around the catalyst based on the catalyst wall surface temperature, the outside air temperature, and the vehicle speed; and a heater control part that causes a heater provided upstream of the catalyst to generate heat when an estimated catalyst wall surface temperature of the catalyst after a first predetermined time period from a current timing, which has been estimated on a basis of the amount of heat transfer and the catalyst wall surface temperature, is lower than a threshold.

2. The catalyst temperature control apparatus according to claim 1, wherein the acquiring part further acquires a first exhaust temperature of an upstream side of the heater in the exhaust passage, a passage wall surface temperature of a wall surface of the upstream side of the heater, and a heater wall surface temperature of a wall surface of the heater, wherein the processor further functions such that the calculation part includes:

a first calculation part that calculates a second exhaust temperature of an inlet of the heater on the basis of i) a first amount of heat transfer that occurs from the wall surface of the upstream side of the heater to the exhaust and the outside air, based on the first exhaust temperature, the exhaust flow rate, the passage wall surface temperature, the outside air temperature, and the vehicle speed, and ii) the first exhaust temperature;

a second calculation part that calculates a third exhaust temperature of an inlet of the catalyst on the basis of i) a second amount of heat transfer that occurs from the wall surface of the heater to the exhaust and the outside air, based on the second exhaust temperature, the exhaust flow rate, the heater wall surface temperature, the outside air temperature, and the vehicle speed, and ii) the second exhaust temperature; and a third calculation part that calculates a third amount of heat transfer that occurs from the wall surface of the catalyst to the exhaust and the outside air, based on the third exhaust temperature, the exhaust flow rate, the catalyst wall surface temperature, the outside air temperature, and the vehicle speed, and wherein the heater control part estimates the estimated catalyst wall surface temperature after the first predetermined time period from the current timing on the basis of the catalyst wall surface temperature and the third amount of heat transfer.

3. The catalyst temperature control apparatus according to claim 1, wherein the heater control part estimates the estimated catalyst wall surface temperature each time a second predetermined time period that is smaller than the first predetermined time period passes.

4. The catalyst temperature control apparatus according to claim 1, wherein the heater control part estimates the estimated catalyst wall surface temperature on the basis of i) a divided value obtained by dividing a product of the amount of heat transfer calculated by the calculation part and a cycle at which the calculation part calculates the amount of heat transfer by heat capacity of the catalyst stored in a storage part, and ii) the catalyst wall surface temperature.

5. The catalyst temperature control apparatus according to claim 2, wherein the heater control part estimates an estimated heater wall surface temperature of the heater after the second predetermined time period from the current timing, on the basis of i) a difference between the second amount of heat transfer and an amount of heat of the heater and ii) the heater wall surface temperature, each time a second predetermined time period that is smaller than the first predetermined time period passes.

6. The catalyst temperature control apparatus according to claim 5, wherein the heater control part estimates the estimated heater wall surface temperature after the second predetermined time period from the current timing, on the basis of i) a subtraction value obtained by subtracting an amount of heat generated by the heater in the second predetermined time period from the second amount of heat transfer calculated by the second calculation part, and ii) the heater wall surface temperature at the current timing, each time the second predetermined time period passes.

7. The catalyst temperature control apparatus according to claim 5, wherein the acquiring part acquires the passage wall surface temperature as an initial value of the heater wall surface temperature, and acquires the estimated heater wall surface temperature as the heater wall surface temperature each time the second predetermined time period passes.

8. The catalyst temperature control apparatus according to claim 2, wherein the first calculation part calculates the first amount of heat transfer, which is obtained by adding together i) a first amount of heat that transfers from the wall surface of the upstream side of the heater to the exhaust based on the first exhaust temperature, the exhaust flow rate, and the passage wall surface temperature, and ii) a second amount of heat that transfers from the wall surface of the upstream side of the heater to outside air around the heater based on the passage wall surface temperature, the outside air temperature, and the vehicle speed.

9. The catalyst temperature control apparatus according to claim 2, wherein the second calculation part calculates the second amount of heat transfer, which is obtained by adding together i) a first amount of heat that transfers from the wall surface of the heater to the exhaust based on the second exhaust temperature, the exhaust flow rate, and the heater wall surface temperature, and ii) a second amount of heat that transfers from the wall surface of the heater to the outside air around the heater based on the heater wall surface temperature, the outside air temperature, and the vehicle speed.

10. The catalyst temperature control apparatus according to claim 2, wherein the third calculation part calculates the third amount of heat transfer, which is obtained by adding together i) a first amount of heat that transfers from the wall surface of the catalyst to the exhaust, based on the third exhaust temperature, the exhaust flow rate, and the catalyst wall surface temperature, and ii) a second amount of heat that transfers from the wall surface of the catalyst to the outside air around the catalyst based on the catalyst wall surface temperature, the outside air temperature, and the vehicle speed.

11. A catalyst temperature control method, executed by a computer, comprising:

acquiring an exhaust temperature of an upstream side of a catalyst in an exhaust passage, an exhaust flow rate in the exhaust passage, a catalyst wall surface temperature of a wall surface of the catalyst, an outside air temperature around the catalyst, and a vehicle speed of a vehicle including the catalyst;

calculating an amount of heat transfer obtained by adding together i) an amount of heat that transfers from the wall surface of the catalyst to exhaust in the exhaust passage based on the exhaust temperature, the exhaust flow rate, and the catalyst wall surface temperature, and ii) an amount of heat that transfers from the wall surface of the catalyst to outside air around the catalyst based on the catalyst wall surface temperature, the outside air temperature, and the vehicle speed; and causing a heater provided upstream of the catalyst in which an estimated catalyst wall surface temperature after a first predetermined time period from a current timing, which has been estimated on a basis of the amount of heat transfer and the catalyst wall surface temperature, is lower than a threshold to generate heat.

* * * * *